United States Patent [19]

Kisman et al.

[11] Patent Number: 5,062,483

[45] Date of Patent: Nov. 5, 1991

[54] TREATMENT FOR REDUCING WATER CONING IN AN OIL RESERVOIR

[75] Inventors: Kenneth E. Kisman; Boyd Russell, both of Calgary, Canada

[73] Assignee: Alberta Oil Sands Technology and Research Authority, Edmonton, Canada

[21] Appl. No.: 538,313

[22] Filed: Jun. 15, 1990

[30] Foreign Application Priority Data

Jun. 15, 1989 [GB] United Kingdom ..... 8913834

[51] Int. Cl.[5] ..... E21B 43/12; E21B 43/16

[52] U.S. Cl. ..... 166/263; 166/261; 166/268; 166/305.1

[58] Field of Search ..... 166/263, 268, 305.1, 166/306, 261

[56] References Cited

U.S. PATENT DOCUMENTS

| | | | |
|---|---|---|---|
| 1,099,170 | 6/1914 | Dunn | 166/268 |
| 2,258,614 | 10/1941 | Kendrick | 166/263 |
| 2,832,416 | 4/1958 | Allen | 166/306 X |
| 3,369,605 | 2/1968 | Donaldson et al. | 166/306 |
| 3,468,129 | 9/1969 | Knutson | 166/305.1 |
| 3,500,914 | 3/1970 | Petteway | 166/268 |
| 3,525,400 | 8/1970 | Pollock et al. | 166/305.1 |
| 4,560,003 | 12/1985 | McMillen et al. | 166/305.1 |
| 4,665,989 | 5/1987 | Wilson | 166/263 X |

*Primary Examiner*—George A. Suchfield

*Attorney, Agent, or Firm*—Millen, White & Zelano

[57] ABSTRACT

The invention has application only to a first oil well producing oil having a high water cut, said oil well being completed in a reservoir having an increased gas saturation, in the vicinity of the first oil well, arising from injection of gas through an adjacent injection well. The first oil well is treated by injecting through it into the reservoir a slug of non-condensible gas in an amount between about 40,000 $m^3$and 200,000 $m^3$. The first well is then placed back on production and its water cut is significantly reduced.

2 Claims, No Drawings

TREATMENT FOR REDUCING WATER CONING IN AN OIL RESERVOIR

FIELD OF THE INVENTION

This invention relates to a method for suppressing water coning in an oil well.

BACKGROUND OF THE INVENTION

Water coning is a phenomenon which commonly occurs with respect to producing wells having an underlying aquifer. Both oil, from the reservoir in which the well is completed, and water, from the underlying strata, have a tendency to move toward the low pressure sink created by the well. As the relative permeability of the formation rock or sand (the "matrix") immediately adjacent the well bore is greater for water than it is for oil, the water will move more easily through the material and will tend to inhibit oil migration there through.

If a well is first placed on production with little or no water production and then the water "cut" in due course suddenly begins to steadily increase, the usual explanation is that "water coning" has occurred.

It is the purpose of the present invention to provide a method for suppressing or reducing water coning.

SUMMARY OF THE INVENTION

The present invention is concerned with a setting involving an injection well and one or more surrounding producer wells which produce water as well as oil. In accordance with the invention, gas is injected into the reservoir through the injection well with the result that communication is established with the producer well so that gas(es) are produced therefrom. The injected gas may be air, to induce combustion in the reservoir, with the result that combustion gases are produced by the producer well. Or the injected gas may be natural gas or the like, which is simply circulated through the formation. In either case, the gas saturation around the producer wellbore is increased. After this step is accomplished, a relatively small slug of non-condensible, between about 50,000 $m^3$ and 200,000 $m^3$, gas is injected into the reservoir through the producer well to increase the gas saturation locally around the well. It is found that, as a result of this combination of steps, the water cut at the producer well is reduced.

DESCRIPTION OF A PREFERRED EMBODIMENT

EXAMPLE

The invention is illustrated by the following examples.

Well #1 was situated adjacent to a combustion project and had been producing trace amounts of oil at approximately 100% water cut. Based on an increase in the concentration of nitrogen and carbon dioxide in the produced gases as a result of the combustion project, the reservoir area surrounding this well was influenced by an increasing gas saturation. This well then received a treatment which consisted of injecting into the formation, 200,000 $m^3$ (standard cubic meters) of natural gas. During gas injection, the formation parting pressure was never exceeded. Following the treatment, the well was shut in for three days and then placed on production. Following the treatment, well #1 produced approximately 20 $m^3$/d oil and no water.

The invention is described in a paper entitled "AWACT: Anti Water Coning Technology" by W. R. Freeborn, F. A. Skoreyko and R. W. Luhning. The paper was presented at the Oil Sands 2000 conference in Edmonton on Mar. 26–28, 1990, and was published by Alberta Oil Sands Technology and Research Authority of Edmonton. The paper is incorporated herein by reference.

The embodiments of the invention in which an exclusive property or privilege is claimed are defined as follows:

1. A method for treating a first oil well completed in an oil reservoir, said reservoir having an increased gas saturation in the vicinity of the first oil well, due to gas having been injected into the reservoir through a second adjacent well, said first oil well having a high water cut, said method comprising:

injecting into the reservoir through the first oil well a slug of non-condensible gas in an amount between about 50,000 $m^3$ and 200,000 $m^3$; and placing the first oil well back on production;

whereby the water cut is reduced.

2. The method as set forth in claim 1 wherein:

the injected non-condensible gas is natural gas.

* * * * *